US009793617B2

(12) United States Patent
Kawamura et al.

(10) Patent No.: US 9,793,617 B2
(45) Date of Patent: Oct. 17, 2017

(54) ELECTRICAL WIRE-CONNECTING STRUCTURE AND METHOD FOR MANUFACTURING ELECTRICAL WIRE-CONNECTING STRUCTURE

(71) Applicants: FURUKAWA ELECTRIC CO., LTD., Tokyo (JP); FURUKAWA AUTOMOTIVE SYSTEMS INC., Inukami-gun (JP)

(72) Inventors: Yukihiro Kawamura, Inukami-gun (JP); Takashi Tonoike, Inukami-gun (JP)

(73) Assignees: FURUKAWA ELECTRIC CO., LTD., Tokyo (JP); FURUKAWA AUTOMOTIVE SYSTEMS INC., Inukami-gun (JP)

( * ) Notice: Subject to any disclaimer, the term of this patent is extended or adjusted under 35 U.S.C. 154(b) by 0 days.

(21) Appl. No.: 15/287,395

(22) Filed: Oct. 6, 2016

(65) Prior Publication Data

US 2017/0025768 A1 Jan. 26, 2017

Related U.S. Application Data

(63) Continuation of application No. PCT/JP2015/068056, filed on Jun. 23, 2015.

(30) Foreign Application Priority Data

Jun. 23, 2014 (JP) ..... 2014-128181

(51) Int. Cl.
*H01R 4/10* (2006.01)
*H01R 4/18* (2006.01)
(Continued)

(52) U.S. Cl.
CPC ..... *H01R 4/183* (2013.01); *H01R 4/62* (2013.01); *H01R 43/048* (2013.01); *H01R 13/52* (2013.01)

(58) Field of Classification Search
CPC ..... H01R 4/183; H01R 43/048
(Continued)

(56) References Cited

U.S. PATENT DOCUMENTS 9,525,215 B2 * 12/2016 Kawamura ..... H01R 4/187
9,531,088 B2 * 12/2016 Kihara ..... H01R 4/20
(Continued)

FOREIGN PATENT DOCUMENTS

JP 2005-276792 10/2005
JP 2010-165630 7/2010
(Continued)

OTHER PUBLICATIONS

International Search Report dated Sep. 29, 2015 in PCT/JP2015/068056 filed on Jun. 23, 2015 (with English Translation).
(Continued)

*Primary Examiner* — Abdullah Riyami
*Assistant Examiner* — Nader Alhawamdeh
(74) *Attorney, Agent, or Firm* — Oblon, McClelland, Maier & Neustadt, L.L.P.

(57) ABSTRACT

Provided is an electrical wire-connecting structure, and a manufacturing method thereof, with which it is easy to ensure watertightness between a crimping terminal and an insulated electrical wire. A crimping terminal (11) having a tubular portion (25) is prepared in which a first cylindrical portion (52) into which a core wire portion (14) of an electrical wire (13) is inserted is formed with a smaller diameter than a second cylindrical portion (54) into which an insulation covering portion (15) of the electrical wire (13) is inserted, and an inner diameter of the second cylindrical
(Continued)

portion (54) is in the range of 1.0 to 1.7 times an outer diameter of the insulation covering portion (15). The electrical wire (13) is inserted into the tubular portion (25), and the second cylindrical portion (54) and the insulation covering portion (15) are compressively crimped.

13 Claims, 4 Drawing Sheets

(51) Int. Cl.
*H01R 43/048* (2006.01)
*H01R 4/62* (2006.01)
*H01R 13/52* (2006.01)

(58) Field of Classification Search
USPC ..... 439/877
See application file for complete search history.

(56) References Cited

U.S. PATENT DOCUMENTS

| | | | |
|---|---|---|---|
| 2013/0233588 | A1 | 9/2013 | Furukawa et al. |
| 2014/0374155 | A1 | 12/2014 | Tachibana et al. |
| 2015/0064991 | A1 | 3/2015 | Kawamura et al. |
| 2015/0126079 | A1 | 5/2015 | Kawamura et al. |
| 2016/0172811 | A1 | 6/2016 | Tachibana et al. |

FOREIGN PATENT DOCUMENTS

| | | |
|---|---|---|
| JP | 4598039 | 12/2010 |
| JP | 2014-49334 | 3/2014 |
| JP | 5521124 | 6/2014 |
| WO | WO 2012/090921 A1 | 7/2012 |
| WO | WO 2013/143011 A1 | 10/2013 |
| WO | WO 2014/014105 A1 | 1/2014 |
| WO | WO 2014/129217 A1 | 8/2014 |

OTHER PUBLICATIONS

Written Opinion dated Sep. 29, 2015 in PCT/JP2015/068056 filed on Jun. 23, 2015.
International Preliminary Report of Patentability and Written Opinion issued Jan. 5, 2017 in PCT/JP2015/068056 (English translation only).

* cited by examiner

ELECTRICAL WIRE-CONNECTING STRUCTURE AND METHOD FOR MANUFACTURING ELECTRICAL WIRE-CONNECTING STRUCTURE

TECHNICAL FIELD

The present invention relates to components that handle the conduction of electricity. More particularly, the present invention relates to an electrical wire-connecting structure composed of an electrical wire and a terminal and a method for manufacturing an electrical wire-connecting structure.

BACKGROUND ART

In, for example, automobiles, wire harnesses (groups of electrical wires) in which a plurality of electrical wires are bundled together are laid and a plurality of electrical devices are electrically connected to each other by the wire harnesses. Wire harnesses are connected to electrical devices, or wire harnesses are connected to each other, via connectors provided to both the wire harnesses and devices. For such an electrical wire, an insulated electrical wire formed by covering a core wire portion (a conductor portion) with an insulator is used. For example, a crimping terminal is connected to an end portion of the core wire exposed by peeling away the covering on the insulated electrical wire, and a connector is then attached via the crimping terminal.

The crimping terminal is made of copper, and thus in the case where the electrical wire is changed from a copper electrical wire to an aluminum electrical wire, the crimping terminal and the electrical wire result in dissimilar metal contact. As such, the metals will easily corrode if water enters. Patent Documents 1 and 2, which disclose structures in which an intermediate cap or a waterproof tube is provided between an open-barrel crimping terminal and an aluminum electrical wire, can be given as examples of techniques for improving watertightness, but these techniques have difficult aspects such as a complicated manufacturing process. Thus to avoid these difficult aspects, the inventors of the present application have proposed a closed-barrel crimping terminal that is intended to simplify corrosion resistance as well as being mass-producible while suppressing production costs (Patent Document 3).

CITATION LIST

Patent Documents

Patent Document 1: Japanese Patent No. 4598039

Patent Document 2: Japanese Unexamined Patent Application Publication No. 2010-165630

Patent Document 3: Japanese Unexamined Patent Application Publication No. 2014-049334

SUMMARY OF INVENTION

Technical Problem

An object of the present invention is to provide an electrical wire-connecting structure, and a method for manufacturing an electrical wire-connecting structure, with which it is easy to ensure watertightness between a crimping terminal and an insulated wire.

Solution to Problem

To solve the above-described problem, the present invention provides a method for manufacturing an electrical wire-connecting structure including a terminal having a tubular portion and an insulated electrical wire having a conductor portion, the terminal and the conductor portion being crimped at the tubular portion. The method includes: preparing the terminal, the terminal having the tubular portion in which a conductor insertion portion into which the conductor portion is inserted is formed with a smaller diameter than a covering insertion portion into which the covering portion of the insulated electrical wire is inserted, and an inner diameter of the covering insertion portion is in the range of 1.0 to 1.7 times an outer diameter of the covering portion; inserting the insulated electrical wire into the tubular portion; and compressively crimping the covering insertion portion and the covering portion.

Additionally, according to the present invention, in the case where the outer diameter of the covering portion of the insulated electrical wire is in the range of 1.3 to 1.9 mm, the inner diameter of the covering portion is set to be in the range of 1.0 to 1.4 times the outer diameter of the covering portion. In this case, a length of the covering insertion portion may be greater than or equal to 0.8 times the outer diameter of the covering portion.

Additionally, according to the present invention, in the case where the outer diameter of the covering portion of the insulated electrical wire is in the range of 1.1 to 1.7 mm, the inner diameter of the covering insertion portion is set to be in the range of 1.0 to 1.5 times the outer diameter of the covering portion. In this case, a length of the covering insertion portion may be greater than or equal to 0.8 times the outer diameter of the covering portion.

Additionally, according to the present invention, in the case where the outer diameter of the covering portion of the insulated electrical wire is in the range of 0.9 to 1.5 mm, the inner diameter of the covering portion is set to be in the range of 1.0 to 1.7 times the outer diameter of the covering portion. In this case, a length of the covering insertion portion may be greater than or equal to 0.7 times the outer diameter of the covering portion.

Additionally, according to the present invention, the inner diameter of the conductor insertion portion is set to be in the range of 1.1 to 2.0 times the outer diameter of the conductor portion.

Additionally, according to the present invention, the covering insertion portion and the conductor insertion portion are formed coaxially.

Additionally, according to the present invention, an end portion of the tubular portion remote from an electrical wire insertion opening is closed so as to form a closed cylindrical body in which portions aside from the electrical wire insertion opening are closed off from the end portion toward the electrical wire insertion opening.

Additionally, according to the present invention, an end portion of the tubular portion remote from an electrical wire insertion opening is closed so as to form a closed cylindrical body in which portions aside from the electrical wire insertion opening are closed off from the end portion toward the electrical wire insertion opening.

Additionally, the present invention provides an electrical wire-connecting structure including a terminal having a tubular portion and an insulated electrical wire having a conductor portion, the terminal and the conductor portion being crimped at the tubular portion. In such an electrical wire-connecting structure, the tubular portion is formed so that a conductor insertion portion into which the conductor portion is inserted is formed with a smaller diameter than a covering insertion portion into which a covering portion of the insulated electrical wire is inserted and so that an inner diameter of the covering insertion portion is in the range of 1.0 to 1.7 times an outer diameter of the covering portion, and the covering insertion portion and the covering portion are compressively crimped.

Advantageous Effects of Invention

According to the present invention, the terminal having the tubular portion is prepared in which the conductor insertion portion into which the conductor portion is inserted is formed with a smaller diameter than the covering insertion portion into which the covering portion of the insulated electrical wire is inserted, and an inner diameter of the covering insertion portion is in the range of 1.0 to 1.7 times an outer diameter of the covering portion; the insulated electrical wire is inserted into the tubular portion; and the covering insertion portion and the covering portion are compressively crimped. Accordingly, it is easy to insert the conductor portion of the insulated electrical wire into the conductor insertion portion, and easy to ensure watertightness between the terminal and the insulated electrical wire.

DESCRIPTION OF EMBODIMENT

Next, an embodiment of the present invention will be described with reference to the drawings.

Figure 1:
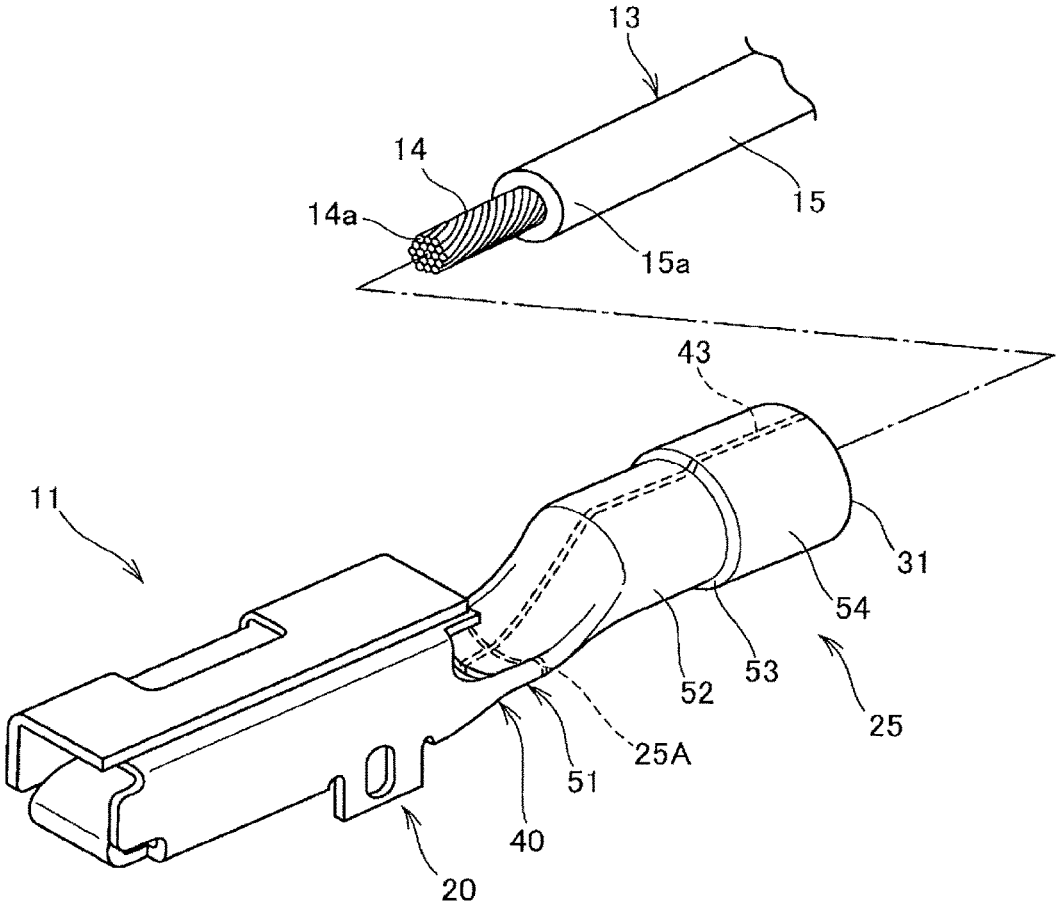
FIG. 1 is a perspective view illustrating an electrical wire-connecting structure according to an embodiment before being joined through crimping.

FIG. 1 is a perspective view illustrating an electrical wire-connecting structure according to the embodiment before being joined through crimping.

This electrical wire-connecting structure 10 is used in a wire harness in an automobile, for example. The electrical wire-connecting structure 10 includes a crimping terminal (tube terminal) 11 and an electrical wire (an insulated electrical wire) 13 joined through crimping (also called bonded through crimping) to the crimping terminal 11. The crimping terminal 11 includes a female terminal box portion 20 and a tubular portion 25, as well as a transition portion 40 that spans therebetween.

The crimping terminal 11 is primarily manufactured from a metal base material (copper or a copper alloy, in the present embodiment) to ensure electrical conductivity and mechanical strength. For example, brass, a Corson-based copper alloy material, or the like is used. Alternatively, a metal member in which a layer composed of tin, nickel, silver, gold, or the like is laid upon a base material may be used. The metal member is formed by applying a plating or reflow process to a metal base material. Note that a plating or reflow process is normally applied before the base material is machined into a terminal form, but such a process may be applied after the base material is machined into the terminal form. Note that the base material of the crimping terminal 11 is not limited to copper or a copper alloy. Aluminum, iron, an alloy primarily composed of one of these materials, or the like can be used as well. The crimping terminal 11 exemplified in the present embodiment is formed into a terminal form by machining a metal member that has been completely plated with tin.

The electrical wire 13 is composed of a core wire portion 14 (a conductor portion) and an insulation covering portion 15 (a covering portion). The core wire portion 14 is composed of metal filaments 14*a* that handle the electricity conduction of the electrical wire 13. The filaments 14*a* are composed of a copper-based material, an aluminum-based material, or the like. An electrical wire having a core wire portion composed of an aluminum-based material (also called an aluminum electrical wire) is lighter in weight than an electrical wire having a core wire portion composed of a copper-based material, and is thus useful in improving, for example, the fuel efficiency of automobiles. The electrical wire 13 according to the present embodiment is formed of the core wire portion 14 covered with the insulation covering portion 15, the core wire portion 14 being formed by the aluminum-alloy filaments 14*a* bundled together, and the insulation covering portion 15 being formed by an insulating resin composed of polyvinyl chloride or the like. The core wire portion 14 is constituted of a twisted wire formed by the filaments 14*a* twisted so as to have a predetermined cross-sectional area. The twisted wire of the core wire portion 14 may be subjected to a compression process after the twisting.

Note that in the case where the filaments 14*a* of the electrical wire 13 are constituted of an aluminum alloy, an aluminum alloy having a composition containing alloy elements such as iron (Fe), copper (Cu), magnesium (Mg), silicon (Si), titanium (Ti), zirconium (Zr), tin (Sn), or manganese (Mn) can be used. A 6000 series aluminum alloy or the like, which is preferably used for wire harnesses, is preferable.

A resin primarily composed of polyvinyl chloride can be given as a representative example of the resin material that constitutes the insulation covering portion 15 of the electrical wire 13. Aside from polyvinyl chloride, a halogen-based resin primarily composed of crosslinked polyvinyl chloride, chloroprene rubber, or the like, a halogen-free resin primarily composed of polyethylene, crosslinked polyethylene, ethylene propylene rubber, silicon rubber, polyester, or the like can be used as well. These resin materials may contain additives such as a plasticizer and a flame retardant.

Figure 2:
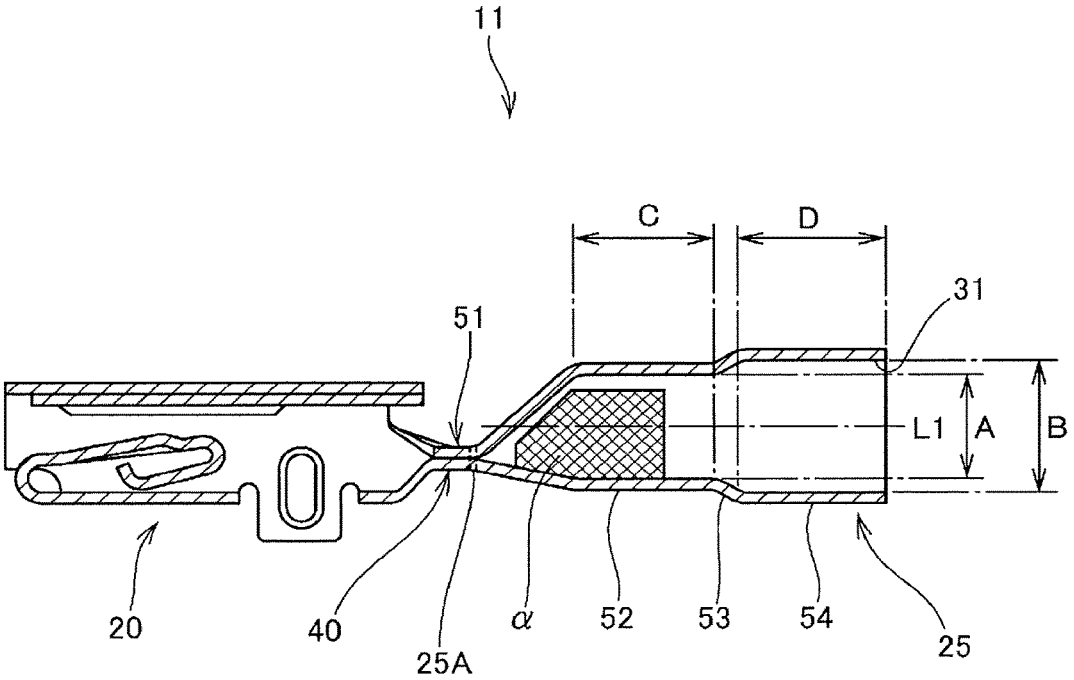
FIG. 2 is a cross-sectional side view of a crimping terminal.

FIG. 2 is a cross-sectional side view of the crimping terminal 11.

The box portion 20 of the crimping terminal 11 is formed as a female terminal box portion that allows the insertion tab of a male terminal, a pin, or the like to be inserted. In the present invention, the shape of a narrow section of this box portion 20 is not particularly limited. That is, it is sufficient for the crimping terminal 11 to include at least the tubular portion 25 via the transition portion 40. The box portion 20 need not be provided, and the box portion 20 may be a male terminal insertion tab, for example. The shape may alternatively be one in which the end portion of a terminal according to another embodiment is connected to the tubular portion 25. To simplify the descriptions of the crimping terminal 11 according to the present invention, the present specification describes an example in which a female box is provided.

The tubular portion 25 is a section where the crimping terminal 11 and the electrical wire 13 are joined through crimping, and is also called a tubular crimping portion. This tubular portion 25 is formed as a hollow tube extending from the transition portion 40 away from the box portion 20, and one end of the tubular portion 25 has an electrical wire insertion opening (open portion) 31 into which the electrical wire 13 can be inserted.

To be more specific, the tubular portion 25 is formed as a stepped hollow tube (also called a stepped tube) whose diameter increases stepwise as the tube progresses toward the electrical wire insertion opening 31, and integrally includes: in order from the transition portion 40, a first cylindrical portion 52 extending as a cylinder in an axial direction of the tubular portion 25; a flaring cylindrical portion 53 whose diameter increases as the tube progresses from the first cylindrical portion 52 toward the electrical wire insertion opening 31; and a second cylindrical portion 54, extending as a cylinder in the axial direction of the tubular portion 25, with the same inner diameter as a maximum inner diameter of the flaring cylindrical portion 53.

The first cylindrical portion 52, the flaring cylindrical portion 53, and the second cylindrical portion 54 are arranged coaxially. In other words, the first cylindrical portion 52, the flaring cylindrical portion 53, and the second cylindrical portion 54 have a common center axis L1.

The other end of the tubular portion 25, located on the electrical wire insertion opening 31 side, is connected to the transition portion 40. The other end of the tubular portion 25 is collapsed or welded so as to be closed for sealing, which prevents moisture or the like from entering from the transition portion 40 side.

In the present embodiment, the other end of the tubular portion 25 is collapsed, before a welding bead portion 25A is formed, thereby closing off the other end of the tubular portion 25.

This tubular portion 25 is composed of for example, a plate formed of a metal member having a tin layer on a copper alloy base material.

Alternatively, the tubular portion 25 may be formed by punching out a copper alloy base material and plating that material with tin before and after subjecting the material to a bending process. It is possible to form the box portion 20, the transition portion 40, and the tubular portion 25 in a continuous state from a single plate, and it is also possible to form the box portion 20 and the tubular portion 25 from the same or different plates and then join those elements at the transition portion 40.

The tubular portion 25 is formed by punching out a base material or a plate of a metal member into a developed form of the crimping terminal 11; subjecting the punched material or plate to a bending process; and joining the material or plate. In the bending process, a cross-section perpendicular to a length direction is formed into a substantially C shape. In the joining, both end surfaces of the open C shape are butted together or overlapped and then joined by welding, crimping, or the like. Laser welding is preferable for the joining used to form the tubular portion 25, but another welding method such as electron beam welding, ultrasonic welding, or resistance welding may be employed instead. The joining may employ a connecting medium such as solder or a blazing material.

The electrical wire 13 is inserted into the tubular portion 25 from the electrical wire insertion opening 31. Accordingly, when discussing the inner diameter of the tubular portion 25, it is assumed that the electrical wire 13 having a perfect circle with that diameter can make contact with the tubular portion 25. That is, even if the tubular portion 25 has, for example, an elliptical, or quadrangular shape, the inner diameter of the tubular portion 25 being r means that the electrical wire 13 having an outer diameter r can be inserted into the tubular portion 25 (however, this does not take into consideration practical issues such as friction resistance and the like at the time of insertion).

The present embodiment describes an example in which the tubular portion 25 is formed through laser welding, and in this example, a welding bead portion 43 (FIG. 1) extending in the axial direction is formed on the tubular portion 25, as illustrated in FIG. 1. The other end of the tubular portion 25, remote from the electrical wire insertion opening 31, has a closed portion 51. The closed portion 51 is closed off by a means such as welding or crimping after being pressed, and is formed to prevent moisture and the like from entering from the transition portion 40 side. This configuration causes the tubular portion 25 to be a closed cylindrical body that is closed off on the transition portion 40 side.

The tubular portion 25 is not limited to the above-described method for joining both end portions of a C-shaped cross-section, and may be formed through a deep-drawing process instead. Furthermore, the tubular portion 25 and the transition portion 40 may be formed by cutting a continuous tube and then closing off one end thereof. Note that it is sufficient for the tubular portion 25 to be tubular, and it is not necessary for the tubular portion 25 to be cylindrical relative to a length direction. The tubular portion 25 may be an elliptical or quadrangular tube. Furthermore, the diameter of the tubular portion 25 need not be constant, and the shape thereof may be such that a radius in the length direction changes.

The electrical wire 13 is inserted into the electrical wire insertion opening 31 of the tubular portion 25 up to an end portion of the insulation covering portion 15 (a cover tip portion 15*a*). In this case, the core wire portion 14 of the electrical wire 13 enters into the first cylindrical portion 52 of the tubular portion 25 and the insulation covering portion 15 of the electrical wire 13 enters into the second cylindrical portion 54 of the tubular portion 25. In other words, the first cylindrical portion 52 functions as a conductor insertion portion into which the core wire portion 14 is inserted, and the second cylindrical portion 54 functions as a covering insertion portion into which the insulation covering portion 15 is inserted.

According to this configuration, the flaring cylindrical portion 53 whose diameter increases as the tubular portion 25 progresses toward the electrical wire insertion opening 31 is provided between the first cylindrical portion 52 and the second cylindrical portion 54 of the tubular portion 25. The flaring cylindrical portion 53 therefore functions as a conductor guide that guides the core wire portion 14 of the electrical wire 13 into the first cylindrical portion 52, allowing the core wire portion 14 to be guided smoothly into the first cylindrical portion 52.

Furthermore, the first cylindrical portion 52, the flaring cylindrical portion 53, and the second cylindrical portion 54 are coaxial, and thus as long as the electrical wire 13 is inserted straight along the center axis L1 of the tubular portion 25, the core wire portion 14 and the insulation covering portion 15 of the electrical wire 13 can be inserted smoothly into the first cylindrical portion 52 and the second cylindrical portion 54, respectively. This makes it easy to eliminate problems such as the core wire portion 14 bending when the electrical wire 13 is inserted into the tubular portion 25.

In the present embodiment, the tubular portion 25 and the electrical wire 13 are joined through crimping by compressing both the first cylindrical portion 52 and the second cylindrical portion 54 of the tubular portion 25.

Figure 3:
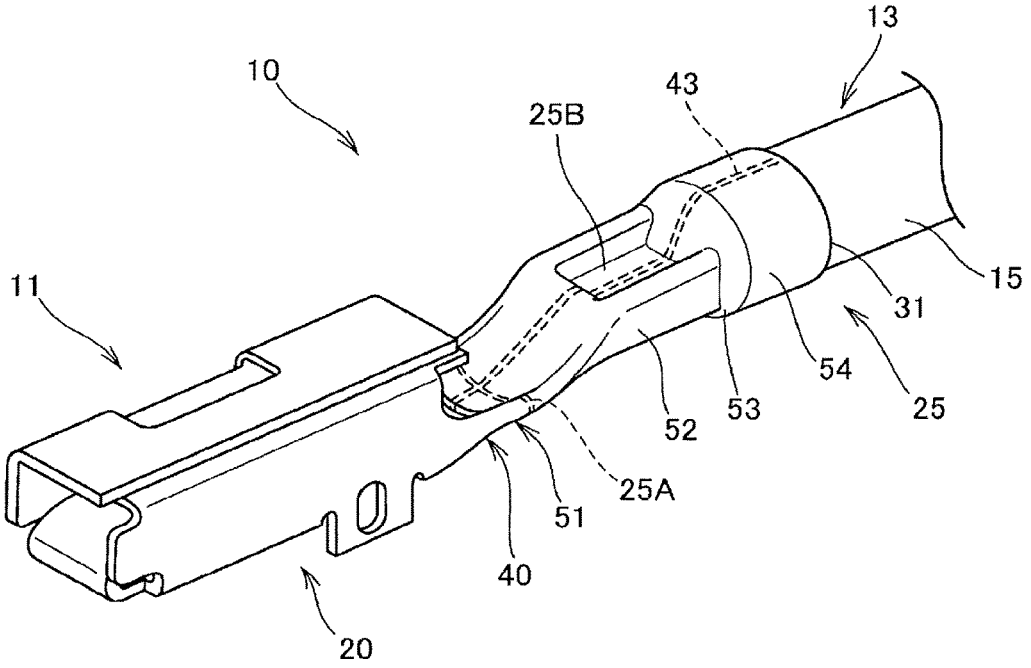
FIG. 3 is a perspective view illustrating the electrical wire-connecting structure after being joined through crimping.

FIG. 3 is a perspective view illustrating the electrical wire-connecting structure 10 after being joined through crimping.

As illustrated in FIG. 3, when being joined through crimping, a region that covers the core wire portion 14 of the electrical wire 13 (the first cylindrical portion 52) is more strongly compressed than a region covering the insulation covering portion 15 of the electrical wire 13 (the second cylindrical portion 54), which forms a crimp impression 25B recessed toward the core wire portion 14.

Holding grooves such as grooves or protrusions (also called serrations; the hatched region in FIG. 2 denoted as a) are provided in the first cylindrical portion 52, and these holding grooves ensure a favorable electrical connection with the electrical wire 13 as well as making the electrical wire 13 less prone to be pulled out.

Figure 4:
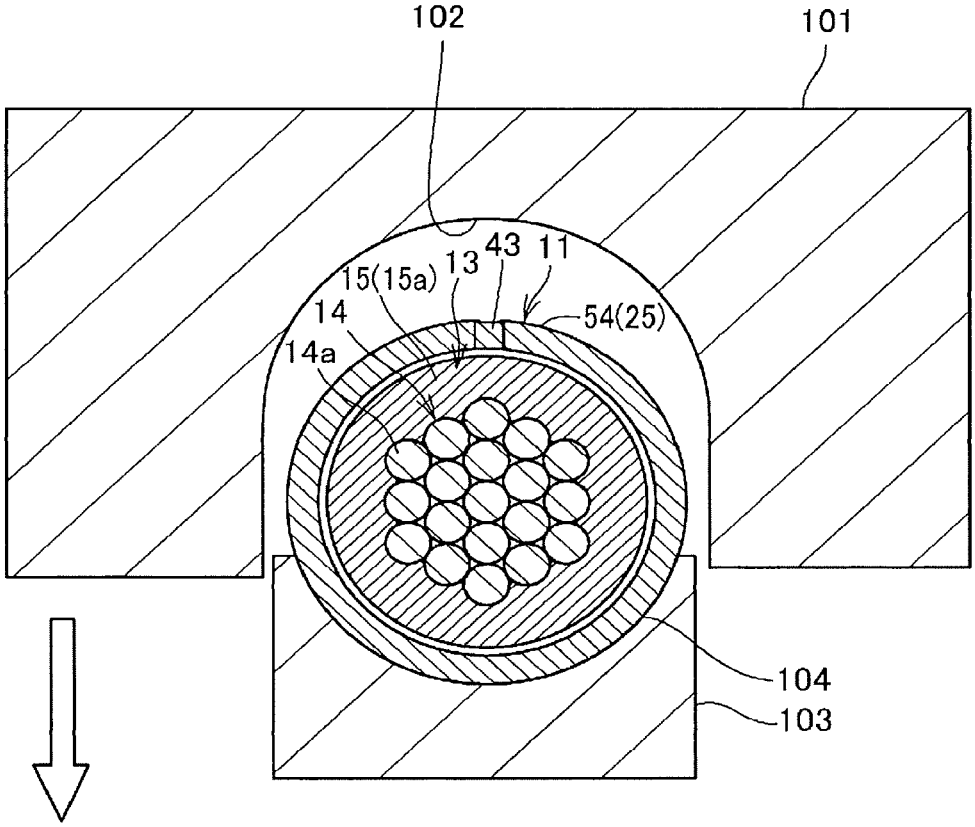
FIG. 4 is a diagram illustrating a process of joining through crimping.

FIG. 4 is a diagram illustrating the process of joining through crimping. Note that FIG. 4 schematically illustrates a cross-section of the second cylindrical portion 54 of the tubular portion 25 (a cross-section perpendicular to the length direction of the electrical wire) along with a crimping parts. The tubular portion 25 of the crimping terminal 11 and the insulation covering portion 15 of the electrical wire 13 are compressed and bonded to each other by using a crimper 101 and an anvil 103. The crimper 101 has a crimping wall 102 that matches the outer shape of the crimping terminal 11, and the anvil 103 has a receiving portion 104 in which the crimping terminal 11 is placed. The receiving portion 104 of the anvil 103 has a curved surface corresponding to the outer shape of the tubular portion 25. As illustrated in FIG. 4, the crimping terminal 11 is placed on the receiving portion 104 with the electrical wire 13 inserted into the crimping terminal 11, and the crimper 101 is lowered as indicated by the arrow in FIG. 4, resulting in the tubular portion 25 being compressed by the crimping wall 102 and the receiving portion 104.

The tubular portion 25 is required to have a function for maintaining conductivity by strongly compressing the core wire portion 14, and a function for maintaining a seal (watertightness) by compressing the insulation covering portion 15 (the cover tip portion 15*a*). It is preferable that a cover crimping portion 36 be crimped so that the cross-section thereof is a substantially perfect circle. This ensures that substantially the same pressure is applied across the entire periphery of the insulation covering portion 15, which produces elastic rebound uniformly across the entire periphery and provides a good seal. The actual crimping process employs a method in which the electrical wire 13, from which a predetermined amount of the core wire portion 14 protrudes, is inserted into the crimping terminal 11, which is set on the anvil 103, after which the crimper 101 is lowered from above, pressure is applied, and the first cylindrical portion 52 and second cylindrical portion 54 are compressed (crimped) simultaneously.

According to this configuration, the tubular portion 25 is formed in a closed tubular shape in which one end is closed off while the other end is left open, which can prevent moisture and the like from entering from the one end side. However, if a gap is present between the crimping terminal 11 and the electrical wire 13 at the other end side of the tubular portion 25, moisture may enter from that gap and adhere to the core wire portion 14. If moisture or the like adheres to the joining portion where the metal base material (copper or a copper alloy) or the metal member (a material having a tin layer on a base material) of the crimping terminal 11 is joined to the core wire portion 14, a difference between the electromotive forces (ionization tendencies) of the respective metals causes a phenomenon in which one of the metals corrodes (electrolytic corrosion, in other words), causing a problem in that the lifespan of the product is shortened. This problem is particularly marked in the case where the base material of the tubular portion 25 is a copper-based material and the core wire portion 14 is an aluminum-based material.

Accordingly, the inventors examined terminal shapes capable of ensuring long-term watertightness between the electrical wire 13 having the insulation covering portion 15 (an insulated electrical wire) and the crimping terminal 11.

Working examples of the electrical wire-connecting structure 10 according to the present invention and comparative examples will be described hereinafter. Note that the present invention is not limited to the following working examples.

Three types of the electrical wires 13 were prepared, in which the cross-sectional area of the conductor, perpendicular to the length direction of the electrical wire 13, was 0.75 $mm^2$, 0.5 $mm^2$, and 0.35 $mm^2$, respectively.

A metal base material made from copper alloy FAS-680 (0.25 mm thick, H material), manufactured by Furukawa Electric Co., Ltd., with a tin layer partially provided on the metal base material was used as the metal member that constitutes the crimping terminal 11. FAS-680 is a Ni—Si based copper alloy. The tin layer was provided through plating.

The filaments 14*a* having an alloy composition of iron (Fe) at approximately 0.2 mass %, copper (Cu) at approximately 0.2 mass %, magnesium (Mg) at approximately 0.1 mass %, silicon (Si) at approximately 0.04 mass %, with the balance being aluminum (Al) and unavoidable impurities were twisted together and used as the core wire portion 14 of the electrical wire 13. The electrical wires 13 having the above-described three types of conductor cross-sectional areas were formed by this core wire portion 14.

A resin primarily composed of polyvinyl chloride (PVC) was used as the insulation covering portion 15 of the electrical wire 13. The insulation covering portion 15 was peeled away from an end portion of the electrical wire 13 using a wire stripper to expose an end portion of the core wire portion 14. In this state, the electrical wire 13 was inserted into the tubular portion 25 of the crimping terminal 11, and the first cylindrical portion 52 and the second cylindrical portion 54 of the tubular portion 25 were then joined through crimping by being compressed by the crimper 101 and the anvil 103, thus producing the electrical wire-connecting structure 10. This was done for a plurality of combinations of electrical wires 13 and crimping terminals 11.

Each sample produced was then subjected to air leak testing to examine whether or not there were air leaks from the gap between the tubular portion 25 and the insulation covering portion 15, and the like. This air leak testing checks for leaks by raising the air pressure to blow air from one end portion of the electrical wire 13 not connected to the crimping terminal 11 into the electrical wire-connecting structure 10. No leak at lower than or equal to 10 kPa (an air leak pressure of higher than or equal to 10 kPa) was defined as a condition for passing the test. Environmental resistance was examined by checking for air leaks after the samples were left for 120 hours at 120° C. (after high-temperature exposure). These samples were also determined to pass the test if the air leak pressure was higher than or equal to 10 kPa. Results of these tests are shown in Tables 1 to 6.

Because the shape of the second cylindrical portion 54 of the tubular portion 25 is important with respect to watertightness, each table clearly lists an inner diameter (tube inner diameter) B and a length (tube length) D of the second cylindrical portion 54 (see FIG. 2), and correspondence relationships between those measurements and the test results.

Tables 1 to 4 also list results of air leak testing following tensile testing. In this tensile testing, the entire crimping terminal 11, in which the electrical wire 13 is joined through crimping to the tubular portion 25, was held, and a tensile load was applied to the electrical wire 13 parallel (at 0°), at 45°, and at 90° relative to the length direction of the crimping terminal 11, up to 50 N. The same air leak testing as that performed after the high-temperature exposure was then carried out.

TABLE 1

(Conductor Cross-sectional Area 0.75 $mm^2$)

| | Tube Inner Diameter B (mm) | Electrical Wire Diameter RB (mm) | Ratio TB | Tube Length D (mm) | Ratio TD | Performance Evaluation through Air Leak Testing: Initial | After High Temperature Exposure | After Tensile Testing |
|---|---|---|---|---|---|---|---|---|
| Working Example | 1.4 | 1.28 | 1.1 | 3.0 | 2.3 | ○ (100% Watertightness) | ○ | ○ |
| | 1.4 | 1.39 | 1.0 | 3.0 | 2.2 | ○ | ○ | ○ |
| | 1.6 | 1.28 | 1.3 | 3.0 | 2.3 | ○ | ○ | ○ |
| | 1.6 | 1.39 | 1.2 | 3.0 | 2.2 | ○ | ○ | ○ |
| | 1.6 | 1.48 | 1.1 | 3.0 | 2.0 | ○ | ○ | ○ |
| | 1.8 | 1.28 | 1.4 | 3.0 | 2.3 | ○ | Δ | ○ |
| | 1.8 | 1.39 | 1.3 | 3.0 | 2.2 | ○ | ○ | ○ |
| | 1.8 | 1.48 | 1.2 | 3.0 | 2.0 | ○ | ○ | ○ |
| | 1.6 | 1.39 | 1.2 | 1.1 | 0.8 | ○ | Δ | Δ |
| | 1.6 | 1.48 | 1.1 | 1.2 | 0.8 | ○ | Δ | Δ |
| | 1.6 | 1.39 | 1.2 | 1.3 | 0.9 | ○ | ○ | Δ |
| | 1.6 | 1.39 | 1.2 | 1.4 | 1.0 | ○ | ○ | ○ |
| | 1.6 | 1.39 | 1.2 | 1.5 | 1.1 | ○ | ○ | ○ |
| | 1.6 | 1.39 | 1.2 | 2.0 | 1.4 | ○ | ○ | ○ |
| | 1.6 | 1.39 | 1.2 | 2.5 | 1.8 | ○ | ○ | ○ |
| | 1.6 | 1.39 | 1.2 | 3.5 | 2.5 | ○ | ○ | ○ |
| | 1.6 | 1.39 | 1.2 | 4.0 | 2.9 | ○ | ○ | ○ |
| | 1.6 | 1.39 | 1.2 | 4.5 | 3.2 | ○ | ○ | Δ |
| Comparative Example | 2.0 | 1.28 | 1.6 | 3.0 | 2.3 | Δ | X | X |
| | 1.9 | 1.28 | 1.5 | 3.0 | 2.3 | Δ | X | X |
| | 2.1 | 1.28 | 1.6 | 3.0 | 2.3 | Δ | X | X |
| | 2.2 | 1.28 | 1.7 | 3.0 | 2.3 | X | X | X |
| | 1.6 | 1.39 | 1.2 | 0.9 | 0.6 | Δ | X | X |
| | 1.6 | 1.39 | 1.2 | 1.0 | 0.7 | Δ | X | X |

Table 1 shows the results of testing the electrical wire 13 having a conductor cross-sectional area of 0.75 $mm^2$. In this test, a covering thickness of the electrical wire 13 was in the range of 0.15 to 0.30 mm, and a plate thickness of the crimping terminal 11 was 0.25 mm.

The table lists a ratio TB between the tube inner diameter B and an electrical wire diameter RB (also called an outer diameter of the insulation covering portion 15 and a finish outer diameter of the electrical wire 13), as well as a ratio TD between the electrical wire diameter RB and the tube length D.

ratio *TB*=(tube inner diameter *B*)/(electrical wire diameter *RB*)

ratio *TD*=(tube length *D*)/(electrical wire diameter *RB*)

The working examples listed in Table 1 meet a condition in which the tube inner diameter B is greater than the diameter of the insulation covering portion 15 of the electrical wire 13, or is smaller than the diameter of the insulation covering portion 15 but the second cylindrical portion 54 is easily deformed so that the diameter thereof is increased when the electrical wire is inserted, thereby allowing the insulation covering portion 15 to be inserted with ease. As such, the joining through crimping can be carried out easily with the method using the crimper 101 and the anvil 103 illustrated in FIG. 4.

As shown in Table 1, no air leak occurred in the initial air leak testing (immediately after manufacture), and furthermore, favorable results were obtained after both the high-temperature exposure and the tensile testing, for the combinations in which the ratio TB was in the range of 1.0 to 1.4, or in other words, in the case where the tube inner diameter B was smaller than the range of 1.0 to 1.4 times the electrical wire diameter RB. To be more specific, favorable results were obtained when the ratio TB was in the range of 1.0 to 1.4, the tube length D was greater than or equal to 1.1 mm, and the ratio TD was higher than or equal to 0.8. Note that a circle (○) in the table indicates 100% watertightness, whereas a triangle indicates watertightness lower than that indicated by the circle but favorable nonetheless. A cross (x) in the table indicates that sufficient watertightness was not achieved.

As opposed to this, in the comparative examples where the ratio TB was in the range of 1.5 to 1.7, favorable watertightness was initially obtained for all samples aside from the sample in which the ratio TB was 1.7; however, the watertightness was insufficient after both the high-temperature exposure and the tensile testing. Furthermore, even in combinations in which the ratio TB was in the range of 1.0 to 1.4, the comparative examples in which the tube length D was less shorter than or equal to 1.0 mm and the ratio TD was lower than or equal to 0.7 had favorable initial watertightness but insufficient watertightness after both the high-temperature exposure and the tensile testing.

The relationship between the tube inner diameter B and the electrical wire diameter RB is particularly important with respect to watertightness, and absolutely no air leak occurs initially if the ratio TB is lower than 1.6 times, making such structures basically usable. However, in the case where the structure is to be used in harsher environments, structures having a ratio TB lower than 1.4, which can withstand high-temperature exposure acceleration testing, are preferable. In other words, it can be seen from Table 1 that setting the tube inner diameter B to from 1.0 to 1.4 times the electrical wire diameter RB is preferable, and less than the range of 1.0 to 1.4 times is further preferable.

With respect to the tube length D, it was confirmed that setting the ratio TD to be in the range of 2.0 to 2.3 makes it possible to ensure watertightness when the tube length D is 3.0 mm, as indicated by the working examples and the comparative examples. It was further confirmed that setting the ratio TD to 0.8 (0.8 to 2.2) or higher makes it possible to ensure watertightness even when the tube length D is shorter than 3.0 mm (1.1 to 3.0 mm), and that setting the ratio TD to 3.2 (2.2 to 3.2) or lower makes it possible to ensure watertightness even when the tube length D is greater than or equal to 3.0 mm (3.0 to 4.5 mm).

Although a shorter tube length D is desirable from the standpoint of making the structure compact, making the tube length D too short weakens the strength of contact with the insulation covering portion 15, resulting in a disadvantage to the watertightness. The inventors et al. confirmed that ensuring the tube length D is greater than or equal to the electrical wire diameter RB, or in other words, that the ratio TD is higher than or equal to 1.0, makes it possible to ensure watertightness. Note that it may be possible to ensure watertightness as long as the tube length D is not extremely smaller than the electrical wire diameter RB, and the ratio TD may be set to a value lower than 1.0. Note that a minimum value of the tube length D is set to a value that meets the initial watertightness, in other words, the initial watertightness will not be met in the case where the tube length D is lower than the minimum value.

Table 2 shows the results of testing the electrical wire 13 having a conductor cross-sectional area of 0.50 $mm^2$. In this test, the covering thickness of the electrical wire 13 was in the range of 0.15 to 0.30 mm, and the plate thickness of the crimping terminal 11 was 0.25 mm.

As shown in Table 2, in the case where the conductor cross-sectional area of the electrical wire 13 is 0.50 $mm^2$, favorable results were obtained initially (immediately after manufacture), after high-temperature exposure, and after tensile testing in the case of combinations in which the ratio TB was in the range of 1.0 to 1.5, or in other words, in the case where the tube inner diameter B was in the range of 1.0 to 1.5 times the electrical wire diameter RB. However, favorable results were not obtained in the comparative examples in which the ratio TB was higher than or equal to 1.6 times.

According to Table 2, it is difficult for air leaks to occur if the ratio TB is lower than 1.7 times, and thus the structure basically can be used. However, in the case where the structure is to be used in harsher environments, structures having a ratio TB of lower than 1.5 times, which can withstand high-temperature exposure acceleration testing, are preferable. In other words, it can be seen from Table 2 that setting the tube inner diameter B to be in the range of 1.0 to 1.5 times the electrical wire diameter RB is preferable, and less than the range of 1.0 to 1.5 times is further preferable.

With respect to the tube length D, it was confirmed that setting the ratio TD to be in the range of 0.8 to 3.5 makes it possible to ensure watertightness, as indicated by the working examples and the comparative examples. However, even if the ratio TD was in the range of 0.8 to 3.5, favorable watertightness could not be ensured with a ratio TD of 2.8 when the ratio TB was in the range of 1.6 to 1.8.

Although a shorter tube length D is desirable from the standpoint of making the structure compact, even with such an electrical wire 13, it was confirmed that ensuring the tube

TABLE 2

(Conductor Cross-sectional Area 0.5 $mm^2$)

| | Electrical | | | | | Performance Evaluation through Air Leak Testing | | |
|---|---|---|---|---|---|---|---|---|
| | Tube Inner Diameter B (mm) | Wire Diameter RB (mm) | Ratio TB | Tube Length D (mm) | Ratio TD | Initial | After High Temperature Exposure | After Tensile Testing |
| Working Example | 1.3 | 1.09 | 1.1 | 3.0 | 2.8 | ○ | ○ | ○ |
| | 1.4 | 1.09 | 1.3 | 3.0 | 2.8 | ○ | ○ | ○ |
| | 1.4 | 1.28 | 1.1 | 3.0 | 2.3 | ○ | ○ | ○ |
| | 1.6 | 1.09 | 1.5 | 3.0 | 2.8 | ○ | Δ | ○ |
| | 1.6 | 1.28 | 1.3 | 3.0 | 2.3 | ○ | ○ | ○ |
| | 1.6 | 1.58 | 1.0 | 3.0 | 1.9 | ○ | ○ | ○ |
| | 1.5 | 1.28 | 1.2 | 1.0 | 0.8 | ○ | Δ | Δ |
| | 1.5 | 1.38 | 1.1 | 1.1 | 0.8 | ○ | Δ | Δ |
| | 1.5 | 1.28 | 1.2 | 1.2 | 0.9 | ○ | ○ | Δ |
| | 1.5 | 1.28 | 1.2 | 1.3 | 1.0 | ○ | ○ | ○ |
| | 1.5 | 1.28 | 1.2 | 1.5 | 1.2 | ○ | ○ | ○ |
| | 1.5 | 1.28 | 1.2 | 2.0 | 1.6 | ○ | ○ | ○ |
| | 1.5 | 1.28 | 1.2 | 2.5 | 2.0 | ○ | ○ | ○ |
| | 1.5 | 1.28 | 1.2 | 3.5 | 2.7 | ○ | ○ | ○ |
| | 1.5 | 1.28 | 1.2 | 4.0 | 3.1 | ○ | ○ | ○ |
| | 1.5 | 1.28 | 1.2 | 4.5 | 3.5 | ○ | ○ | Δ |
| Comparative Example | 1.8 | 1.09 | 1.7 | 3.0 | 2.8 | Δ | X | X |
| | 1.7 | 1.09 | 1.6 | 3.0 | 2.8 | Δ | X | X |
| | 1.9 | 1.09 | 1.7 | 3.0 | 2.8 | Δ | X | X |
| | 2.0 | 1.09 | 1.8 | 3.0 | 2.8 | X | X | X |
| | 1.5 | 1.28 | 1.2 | 0.8 | 0.6 | Δ | X | X |
| | 1.5 | 1.28 | 1.2 | 0.9 | 0.7 | Δ | X | X |

length D is greater than or equal to the electrical wire diameter RB, or in other words, that the ratio TD is higher than or equal to 1.0, makes it possible to ensure watertightness. Note that it may be possible to ensure watertightness as long as the tube length D is not extremely shorter than the electrical wire diameter RB, and thus the ratio TD may be set to a value lower than 1.0. However, the tube length D is set to a value that meets the initial watertightness.

TABLE 3

(Conductor Cross-sectional Area 0.35 $mm^2$)

| | Tube Inner Diameter B (mm) | Electrical Wire Diameter RB (mm) | Ratio TB | Tube Length D (mm) | Ratio TD | Performance Evaluation through Air Leak Testing: Initial | After High Temperature Exposure | After Tensile Testing |
|---|---|---|---|---|---|---|---|---|
| Working Example | 0.9 | 0.89 | 1.0 | 3.0 | 3.4 | ○ | ○ | ○ |
| | 1.2 | 0.89 | 1.3 | 3.0 | 3.4 | ○ | ○ | ○ |
| | 1.2 | 1.19 | 1.0 | 3.0 | 2.5 | ○ | ○ | ○ |
| | 1.5 | 0.89 | 1.7 | 3.0 | 3.4 | ○ | ○ | ○ |
| | 1.5 | 1.19 | 1.3 | 3.0 | 2.5 | ○ | ○ | ○ |
| | 1.5 | 1.48 | 1.0 | 3.0 | 2.0 | ○ | ○ | ○ |
| | 1.3 | 1.09 | 1.2 | 0.8 | 0.7 | ○ | Δ | Δ |
| | 1.3 | 1.28 | 1.0 | 1.0 | 0.8 | ○ | Δ | Δ |
| | 1.3 | 1.09 | 1.2 | 1.1 | 1.0 | ○ | ○ | Δ |
| | 1.3 | 1.09 | 1.2 | 1.2 | 1.1 | ○ | ○ | ○ |
| | 1.3 | 1.09 | 1.2 | 1.5 | 1.4 | ○ | ○ | ○ |
| | 1.3 | 1.09 | 1.2 | 2.0 | 1.8 | ○ | ○ | ○ |
| | 1.3 | 1.09 | 1.2 | 2.5 | 2.3 | ○ | ○ | ○ |
| | 1.3 | 1.09 | 1.2 | 3.5 | 3.2 | ○ | ○ | ○ |
| | 1.3 | 1.09 | 1.2 | 4.0 | 3.7 | ○ | ○ | ○ |
| | 1.3 | 1.09 | 1.2 | 4.5 | 4.1 | ○ | ○ | Δ |
| Comparative Example | 1.7 | 0.89 | 1.9 | 3.0 | 3.4 | Δ | X | X |
| | 1.6 | 0.89 | 1.8 | 3.0 | 3.4 | Δ | X | X |
| | 1.8 | 0.89 | 2.0 | 3.0 | 3.4 | X | X | X |
| | 1.3 | 1.09 | 1.2 | 0.6 | 0.6 | Δ | X | X |
| | 1.3 | 1.09 | 1.2 | 0.7 | 0.6 | Δ | X | X |

Table 3 shows the results of testing the electrical wire 13 having a conductor cross-sectional area of 0.35 $mm^2$. In this test, a covering thickness of the electrical wire 13 was in the range of 0.15 to 0.30 mm, and a plate thickness of the crimping terminal 11 was 0.25 mm.

As shown in Table 3, in the case where the conductor cross-sectional area of the electrical wire 13 is 0.35 $mm^2$, favorable results were obtained initially (immediately after manufacture), after high-temperature exposure, and after tensile testing in the case of combinations in which the ratio TB was in the range of 1.0 to 1.7, or in other words, in the case where the tube inner diameter B was in the range of 1.0 to 1.7 times the electrical wire diameter RB. However, favorable results were not obtained in the comparative examples in which the ratio TB was higher than or equal to 1.8 times.

According to Table 3, air leaks hardly occur if the ratio TB is lower than 1.9 times, and thus the structure basically can be used. However, in the case where the structure is to be used in harsher environments, structures having a ratio TB of lower than or equal to 1.7 times, which can withstand high-temperature exposure acceleration testing, are preferable. In other words, it can be seen that setting the tube inner diameter B to be in the range of 1.0 to 1.7 times the electrical wire diameter RB is effective.

With respect to the tube length D, it was confirmed that setting the ratio TD to be in the range of 0.7 to 4.1 makes it possible to ensure watertightness, as indicated by the working examples and the comparative examples. However, even if the ratio TD was in the range of 0.7 to 4.1, favorable watertightness could not be ensured with a ratio TD of 3.4 when the ratio TB was in the range of 1.8 to 2.0.

Although a shorter tube length D is desirable from the standpoint of making the structure compact, even with such an electrical wire 13, it was confirmed that ensuring the tube length D is greater than or equal to the electrical wire diameter RB, or in other words, that the ratio TD is higher than or equal to 1.0, makes it possible to ensure watertightness. Note that it may be possible to ensure watertightness as long as the tube length D is not extremely smaller than the electrical wire diameter RB, and thus the ratio TD may be set to a value lower than 1.0. However, the tube length D is set to a value that meets the initial watertightness.

Table 4 to Table 6 show testing results for a tube inner diameter A and a tube length C of the first cylindrical portion 52 (see FIG. 2).

The tube inner diameter A and the tube length C are items that contribute to abnormal deformation such as terminal inner falling after crimping, and thus the inventors et al. considered these points as well.

TABLE 4

(Conductor Cross-sectional Area 0.75 $mm^2$)

| | Tube Inner Diameter A (mm) | Conductor Outer Diameter RA (mm) | Ratio TA | Tube Length C (mm) | Ratio TC | Performance Evaluation through Air Leak Testing: Initial | After High Temperature Exposure | Abnormal Deformation | After Tensile Testing |
|---|---|---|---|---|---|---|---|---|---|
| Working Example | 1.0 | 0.91 | 1.1 | 2.6 | 2.9 | ○ | ○ | ○ | ○ |
| | 1.4 | 0.91 | 1.5 | 2.6 | 2.9 | ○ | ○ | Δ | ○ |
| | 1.4 | 1.12 | 1.3 | 2.6 | 2.3 | ○ | ○ | ○ | ○ |
| | 1.4 | 1.31 | 1.1 | 2.6 | 2.0 | ○ | ○ | ○ | ○ |
| | 1.6 | 0.91 | 1.8 | 2.6 | 2.9 | ○ | Δ | Δ | Δ |
| | 1.6 | 1.12 | 1.4 | 2.6 | 2.3 | ○ | ○ | ○ | ○ |
| | 1.6 | 1.31 | 1.2 | 2.6 | 2.0 | ○ | ○ | ○ | ○ |
| | 1.8 | 0.91 | 2.0 | 2.6 | 2.9 | Δ | X | X | ○ |
| | 1.4 | 1.02 | 1.4 | 2.2 | 2.2 | ○ | ○ | ○ | ○ |
| | 1.4 | 1.02 | 1.4 | 3.0 | 2.9 | ○ | ○ | ○ | ○ |
| | 1.4 | 1.02 | 1.4 | 3.5 | 3.4 | ○ | ○ | ○ | ○ |
| | 1.4 | 1.02 | 1.4 | 4.0 | 3.9 | ○ | ○ | ○ | ○ |
| Comparative Example | 1.8 | 0.91 | 2.0 | 2.6 | 2.9 | Δ | X | X | X |
| | 1.7 | 0.91 | 1.9 | 2.6 | 2.9 | Δ | X | X | X |
| | 1.9 | 0.91 | 2.1 | 2.6 | 2.9 | X | X | X | X |

Table 4 shows the results of testing the electrical wire 13 having a conductor cross-sectional area of 0.75 $mm^2$. In this test, a covering thickness of the electrical wire 13 was in the range of 0.15 to 0.30 mm, and a plate thickness of the crimping terminal 11 was 0.25 mm. The tube inner diameter B was 1.6 mm in the working examples, whereas the tube inner diameter B was 1.8 mm in the comparative examples.

Table 4 to Table 6 also show a ratio TA between the tube inner diameter A and a conductor outer diameter RA (an outer diameter of the core wire portion 14), and a ratio TC between the conductor outer diameter RA and the tube length C.

ratio *TA*=(tube inner diameter *A*)/(conductor outer diameter *RA*)

ratio *TC*=(tube length *C*)/(conductor outer diameter *RA*)

As shown in Table 4, in the case where the conductor cross-sectional area of the electrical wire 13 is 0.75 $mm^2$, favorable watertightness was obtained initially (immediately after manufacture), after high-temperature exposure, and after tensile testing in the case of combinations in which the ratio TA was in the range of 1.1 to 1.8, or in other words, in the case where the tube inner diameter A was in the range of 1.1 to 1.8 times the conductor outer diameter RA. A further result was obtained in that abnormal deformation such as terminal inner falling after crimping can be sufficiently prevented. It was confirmed that watertightness that can withstand high-temperature exposure acceleration testing can be obtained, and that abnormal deformation can be suppressed, in the more preferable case where the ratio TA is lower than or equal to 1.4, or in other words, in the case where the tube inner diameter A is smaller than or equal to 1.4 times the conductor outer diameter RA. As opposed to this, favorable results were not obtained with the comparative examples in which the ratio TA was higher than or equal to 1.9 times.

With respect to the tube length C, it was confirmed that setting the ratio TC to be in the range of 2.0 to 3.9 makes it possible to ensure watertightness and prevent abnormal deformation, as indicated by the working examples. From the standpoint of suppressing deformation related to watertightness and preventing abnormal deformation, it is desirable that the tube length C be relatively long. As such, based on the above results, it is preferable to ensure a tube length C of greater than or equal to two times the conductor outer diameter RA. Ensuring a length of greater than or equal to two times also makes it easy to ensure a surface area of the holding grooves (serrations) denoted as α in FIG. 2, which ensures a favorable electrical connection and makes the electrical wire 13 less prone to be pulled out.

However, in the case where a minimum value of the tube length C is set to a length that meets a tensile mechanical strength of the first cylindrical portion 52 serving as the conductor insertion portion, or in other words, in the case where the tube length C is lower than the minimum value, the tensile mechanical strength of the first cylindrical portion 52 can no longer be ensured. This makes it difficult to use the structure in automobiles.

TABLE 5

(Conductor Cross-sectional Area 0.5 $mm^2$)

| | Conductor: Tube Inner Diameter A (mm) | Outer Diameter RA (mm) | Ratio TA | Tube Length C (mm) | Ratio TC | Performance Evaluation through Air Leak Testing: Initial | After High Temperature Exposure | Abnormal Deformation | After Tensile Testing |
|---|---|---|---|---|---|---|---|---|---|
| Working Example | 0.9 | 0.81 | 1.1 | 2.6 | 3.2 | ○ | ○ | ○ | ○ |
| | 1.2 | 0.81 | 1.5 | 2.6 | 3.2 | ○ | ○ | ○ | ○ |
| | 1.2 | 0.91 | 1.3 | 2.6 | 2.9 | ○ | ○ | ○ | ○ |
| | 1.2 | 1.02 | 1.2 | 2.6 | 2.5 | ○ | ○ | ○ | ○ |

TABLE 5-continued

| (Conductor Cross-sectional Area 0.5 mm$^2$) | | | | | | | | | |
|---|---|---|---|---|---|---|---|---|---|
| | Conductor | | | | | Performance Evaluation through Air Leak Testing | | | |
| | Tube Inner Diameter A (mm) | Outer Diameter RA (mm) | Ratio TA | Tube Length C (mm) | Ratio TC | Initial | After High Temperature Exposure | Abnormal Deformation | After Tensile Testing |
| | 1.4 | 0.81 | 1.7 | 2.6 | 3.2 | ○ | Δ | Δ | Δ |
| | 1.4 | 0.91 | 1.5 | 2.6 | 2.9 | ○ | ○ | ○ | ○ |
| | 1.4 | 1.02 | 1.4 | 2.6 | 2.5 | ○ | ○ | ○ | ○ |
| | 1.2 | 0.81 | 1.5 | 2.0 | 2.5 | ○ | ○ | ○ | ○ |
| | 1.2 | 0.81 | 1.5 | 2.2 | 2.7 | ○ | ○ | ○ | ○ |
| | 1.2 | 0.81 | 1.5 | 3.0 | 3.7 | ○ | ○ | ○ | ○ |
| | 1.2 | 0.81 | 1.5 | 3.5 | 4.3 | ○ | ○ | ○ | ○ |
| | 1.2 | 0.81 | 1.5 | 4.0 | 4.9 | ○ | ○ | ○ | ○ |
| Comparative | 1.6 | 0.81 | 2.0 | 2.6 | 3.2 | Δ | X | X | X |
| Example | 1.5 | 0.81 | 1.9 | 2.6 | 3.2 | Δ | X | X | X |
| | 1.7 | 0.81 | 2.1 | 2.6 | 3.2 | X | X | X | X |

Table 5 shows the results of testing the electrical wire 13 having a conductor cross-sectional area of 0.50 mm$^2$. In this test, a covering thickness of the electrical wire 13 was in the range of 0.15 to 0.30 mm, and a plate thickness of the crimping terminal 11 was 0.25 mm. The tube inner diameter B was 1.4 mm in the working examples, whereas the tube inner diameter B was 1.6 mm in the comparative examples.

As shown in Table 5, in the case where the conductor cross-sectional area of the electrical wire 13 is 0.50 mm$^2$, favorable watertightness was obtained initially (immediately after manufacture), after high-temperature exposure, and after tensile testing in the case of combinations in which the ratio TA was in the range of 1.1 to 1.7, or in other words, in the case where the tube inner diameter A was in the range of 1.1 to 1.7 times the conductor outer diameter RA. A further result was obtained in that abnormal deformation such as terminal inner falling after crimping can be sufficiently prevented. It was confirmed that watertightness that can withstand high-temperature exposure acceleration testing can be obtained, and that abnormal deformation can be suppressed, in the more preferable case where the ratio TA is lower than or equal to 1.5, or in other words, in the case where the tube inner diameter A is less than or equal to 1.5 times the conductor outer diameter RA. As opposed to this, favorable results were not obtained in the comparative examples in which the ratio TA was higher than or equal to 1.9 times.

With respect to the tube length C, it was confirmed that setting the ratio TC to be in the range of 2.5 to 4.9 makes it possible to ensure watertightness and prevent abnormal deformation, as indicated by the working examples. Additionally, setting the tube length C to the same 2.6 mm as in Table 4 makes it possible to achieve commonality with the electrical wire 13 having a conductor cross-sectional area of 0.75 mm$^2$. Furthermore, ensuring a tube length C of greater than or equal to two times the conductor outer diameter RA ensures a favorable electrical connection and makes the electrical wire 13 less prone to be pulled out.

However, the tube length C is set to a value at which the tensile mechanical strength of the first cylindrical portion 52 serving as the conductor insertion portion is ensured, so as to be suited for use in automobiles and the like.

TABLE 6

| (Conductor Cross-sectional Area 0.35 mm$^2$) | | | | | | | | | |
|---|---|---|---|---|---|---|---|---|---|
| | Conductor | | | | | Performance Evaluation through Air Leak Testing | | | |
| | Tube Inner Diameter A (mm) | Outer Diameter RA (mm) | Ratio TA | Tube Length C (mm) | Ratio TC | Initial | After High Temperature Exposure | Abnormal Deformation | After Tensile Testing |
| Working | 0.7 | 0.61 | 1.1 | 2.6 | 4.3 | ○ | ○ | ○ | ○ |
| Example | 1.0 | 0.61 | 1.6 | 2.6 | 4.3 | ○ | ○ | ○ | ○ |
| | 1.0 | 0.71 | 1.4 | 2.6 | 3.7 | ○ | ○ | ○ | ○ |
| | 1.0 | 0.81 | 1.2 | 2.6 | 3.2 | ○ | ○ | ○ | ○ |
| | 1.2 | 0.61 | 2.0 | 2.6 | 4.3 | ○ | Δ | Δ | Δ |
| | 1.2 | 0.72 | 1.7 | 2.6 | 3.6 | ○ | ○ | Δ | Δ |
| | 1.2 | 0.81 | 1.5 | 2.6 | 3.2 | ○ | ○ | ○ | ○ |
| | 1.0 | 0.72 | 1.4 | 2.0 | 2.8 | ○ | ○ | ○ | ○ |
| | 1.0 | 0.72 | 1.4 | 2.2 | 3.1 | ○ | ○ | ○ | ○ |
| | 1.0 | 0.72 | 1.4 | 3.0 | 4.2 | ○ | ○ | ○ | ○ |
| | 1.0 | 0.72 | 1.4 | 3.5 | 4.9 | ○ | ○ | ○ | ○ |
| | 1.0 | 0.72 | 1.4 | 4.0 | 5.6 | ○ | ○ | ○ | ○ |
| Comparative | 1.4 | 0.61 | 2.3 | 2.6 | 4.3 | Δ | X | X | X |
| Example | 1.3 | 0.61 | 2.1 | 2.6 | 4.3 | Δ | X | X | X |
| | 1.5 | 0.61 | 2.5 | 2.6 | 4.3 | X | X | X | X |

Table 6 shows the results of testing the electrical wire 13 having a conductor cross-sectional area of 0.35 $mm^2$. In this test, a covering thickness of the electrical wire 13 was in the range of 0.15 to 0.30 mm, and a plate thickness of the crimping terminal 11 was 0.25 mm. The tube inner diameter B was 1.2 mm in the working examples, whereas the tube inner diameter B was 1.4 mm in the comparative examples.

As shown in Table 6, in the case where the conductor cross-sectional area of the electrical wire 13 is 0.35 $mm^2$, favorable watertightness was obtained initially (immediately after manufacture), after high-temperature exposure, and after tensile testing in the case of combinations in which the ratio TA was in the range of 1.1 to 2.0, or in other words, in the case where the tube inner diameter A was in the range of 1.1 to 2.0 times the conductor outer diameter RA. A further result was obtained in that abnormal deformation such as terminal inner falling after crimping can be sufficiently prevented. It was confirmed that watertightness that can withstand high-temperature exposure acceleration testing can be obtained, and that abnormal deformation can be suppressed, in the more preferable case where the ratio TA is lower than or equal to 1.6, or in other words, in the case where the tube inner diameter A is smaller than or equal to 1.4 times the conductor outer diameter RA.

As opposed to this, favorable results were not obtained in the comparative examples in which the ratio TA was higher than or equal to 2.1 times.

With respect to the tube length C, it was confirmed that setting the ratio TC to be in the range of 2.8 to 5.6 makes it possible to ensure watertightness and prevent abnormal deformation, as indicated by the working examples. Additionally, setting the tube length C to the same 2.6 mm as in Table 3 and Table 4 makes it possible to achieve commonality with the electrical wires 13 having conductor cross-sectional areas of 0.75 $mm^2$ and 0.50 $mm^2$. Furthermore, ensuring a ratio TC of higher than or equal to two times makes it possible to ensure a favorable electrical connection and makes it easier to make the core wire portion 14 less prone to be pulled out.

However, the tube length C is set to a value at which a sufficient tensile mechanical strength of the first cylindrical portion 52 serving as the conductor insertion portion can be ensured, so as to be suited for use in automobiles and the like.

Having carried out such tests, the inventors et al. confirmed that a tube inner diameter B in the range of 1.0 to 1.4 times the electrical wire diameter RB is preferable in the case of the electrical wire 13 having a conductor cross-sectional area of 0.75 $mm^2$, and that exceeding 1.5 times is disadvantageous in terms of watertightness. Additionally, it was confirmed that the tube length D does not interfere with the watertightness as long as the tube length D is in the range of 0.8 to 3.2 times the electrical wire diameter RB, and that a tube length D of greater than or equal to 1.0 mm, and a ratio TD of higher than or equal to 0.8, are preferable. It was further confirmed that a tube inner diameter A of 1.1 to 1.8 times the conductor outer diameter RA is preferable, and that a tube inner diameter A exceeding 2.0 times is disadvantageous in terms of preventing abnormal deformation such as terminal inner falling. Furthermore, it was confirmed that favorable performance can be maintained as long as the tube length C is within the range of 2.0 to 3.9 times the conductor outer diameter RA.

Additionally, it was confirmed that a tube inner diameter B of 1.0 to 1.5 times the electrical wire diameter RB is preferable in the case of the electrical wire 13 having a conductor cross-sectional area of 0.50 $mm^2$, and that values exceeding 1.6 times gradually become more disadvantageous in terms of watertightness. Additionally, it was confirmed that the tube length D does not interfere with the watertightness as long as the tube length D is in the range of 0.8 to 3.5 times the electrical wire diameter RB. It was further confirmed that a tube inner diameter A of 1.1 to 1.7 times the conductor outer diameter RA is preferable, and that a tube inner diameter A exceeding 2.0 times is disadvantageous in terms of preventing abnormal deformation such as terminal inner falling. Furthermore, it was confirmed that favorable performance can be maintained as long as the tube length C is within the range of 2.5 to 4.9 times the conductor outer diameter RA.

Additionally, it was confirmed that a tube inner diameter B in the range of 1.0 to 1.7 times the electrical wire diameter RB is preferable in the case of the electrical wire 13 having a conductor cross-sectional area of 0.35 $mm^2$, and that exceeding 1.9 times is disadvantageous in terms of watertightness. Additionally, it was confirmed that the tube length D does not interfere with the watertightness as long as the tube length D is in the range of 0.8 to 3.4 times the electrical wire diameter RB. It was further confirmed that a tube inner diameter A in the range of 1.1 to 2.0 times the conductor outer diameter RA is preferable, and that a tube inner diameter A of 2.3 times or greater is disadvantageous in terms of preventing abnormal deformation such as terminal inner falling. Furthermore, it was confirmed that favorable performance can be maintained as long as the tube length C is in the range of 2.8 to 5.6 times the conductor outer diameter RA.

Note that regardless of the conductor cross-sectional area, the tube length D is set to meet the initial watertightness, and a tube length D lower than the minimum value will not meet the initial watertightness. Additionally, in the case where the tube length C is set to a length that ensures the tensile mechanical strength of the first cylindrical portion 52 serving as the conductor insertion portion, and the tube length C is lower than the minimum value, the tensile mechanical strength of the first cylindrical portion 52 can no longer be ensured. This makes it difficult to use the structure in automobiles.

Incidentally, it is known that in an electrical wire 13 having a conductor cross-sectional area in the range of 0.35 to 0.75 $mm^2$, the electrical wire diameter RB and/or the conductor outer diameter RA will differ depending on the structure of the core wire portion 14 (the number of filaments and the like) and/or the covering thickness of the electrical wire 13.

The inventors et al. examined structures having a variety of electrical wire diameters RB and conductor outer diameters RA and meeting the above-described conditions. Results of these examinations are shown in Table 7.

TABLE 7

| Electrical Wire | | | Crimping Terminal | | | |
|---|---|---|---|---|---|---|
| Conductor Cross-sectional Area ($mm^2$) | Conductor Outer Diameter RA (mm) | Electrical Wire Diameter RB (mm) | Tube Inner Diameter A (mm) | Tube Inner Diameter B (mm) | Tube Length C (mm) | Tube Length D (mm) |
| 0.75 | 1.0 (min 0.9, max 1.3) | 1.4 (min 1.3, max 1.9) | 1.4 (min 1.0, max 1.6) | 1.65 (min 1.4, max 2.1) | 2.6 (min 1.3, max 4.5) | 3.0 (min 1.1, max 4.5) |
| 0.50 | 0.85 (min 0.8, max 1.1) | 1.25 (min 1.1, max 1.7) | 1.2 (min 0.85, max 1.4) | 1.45 (min 1.25, max 1.9) | 2.6 (min 1.2, max 4.5) | 3.0 (min 0.95, max 4.5) |
| 0.35 | 0.7 (min 0.6, max 0.9) | 1.1 (min 0.9, max 1.5) | 1.0 (min 0.7, max 1.2) | 1.25 (min 1.1, max 1.7) | 2.6 (min 1.0, max 4.5) | 3.0 (min 0.8, max 4.5) |

As shown in Table 7, with respect to the electrical wire 13 having a conductor cross-sectional area of 0.75 $mm^2$, it is preferable that the electrical wire diameter RB be in the range of 1.3 to 1.9 mm and the conductor outer diameter RA be in the range of 0.9 to 1.3 mm; with respect to the crimping terminal 11 used for this electrical wire 13, it is preferable, from the standpoint of watertightness and preventing abnormal deformation, that the tube inner diameter A be in the range of 1.0 to 1.6 mm, the tube inner diameter B be in the range of 1.4 to 2.1 mm, the tube length C be in the range of 1.3 to 4.5 mm, and the tube length D be in the range of 1.1 to 4.5 mm.

Furthermore, with respect to the electrical wire 13 having a conductor cross-sectional area of 0.50 $mm^2$, it is preferable that the electrical wire diameter RB be in the range of 1.1 to 1.7 mm and the conductor outer diameter RA be in the range of 0.8 to 1.1 mm; with respect to the crimping terminal 11 used for this electrical wire 13, it is preferable, from the standpoint of watertightness and preventing abnormal deformation, that the tube inner diameter A be in the range of 0.85 to 1.4 mm, the tube inner diameter B be in the range of 1.25 to 1.9 mm, the tube length C be in the range of 1.2 to 4.5 mm, and the tube length D be in the range of 1.0 to 4.5 mm.

Additionally, with respect to the electrical wire 13 having a conductor cross-sectional area of 0.35 $mm^2$, it is preferable that the electrical wire diameter RB be in the range of 0.9 to 1.5 mm and the conductor outer diameter RA be in the range of 0.6 to 0.9 mm; with respect to the crimping terminal 11 used for this electrical wire 13, it is preferable, from the standpoint of watertightness and preventing abnormal deformation, that the tube inner diameter A be in the range of 0.7 to 1.2 mm, the tube inner diameter B be in the range of 1.1 to 1.7 mm, the tube length C be in the range of 1.0 to 4.5 mm, and the tube length D be in the range of 0.8 to 4.5 mm.

Values substantially in the center of the above ranges are listed in Table 7. Manufacturing the structures using these substantially central values makes it easy to keep an error within the ranges even if the error arises during the manufacture.

As described above, in the present embodiment, the crimping terminal 11 is prepared, the crimping terminal 11 having the tubular portion 25 in which the first cylindrical portion 52 (the conductor insertion portion) into which the core wire portion 14 of the electrical wire 13 is inserted is formed to have a smaller diameter than the second cylindrical portion 54 (the covering insertion portion) into which the insulation covering portion 15 of the electrical wire 13 is inserted, and the inner diameter of the second cylindrical portion 54 (the tube inner diameter B) is in the range of 1.0 to 1.7 times the outer diameter of the insulation covering portion 15 (the electrical wire diameter RB); the electrical wire 13 is inserted into the tubular portion 25, and the second cylindrical portion 54 and the insulation covering portion 15 are compressively crimped. This makes it easy to insert the core wire portion 14 of the electrical wire 13 into the first cylindrical portion 52 and makes it easy to ensure watertightness between the crimping terminal 11 and the insulated electrical wire 13.

This in turn suppresses corrosion of the tubular portion 25 and/or the electrical wire 13, which makes it possible to extend the lifespan of the product. The closed cylindrical body is also formed through press machining and laser welding, and thus the structure is easily suited to mass production.

Furthermore, these conditions can also be applied with ease to other crimping terminals 11 that crimp electrical wires 13 whose conductor cross-sectional areas are not in the range of 0.35 to 0.75 $mm^2$, and doing so makes it easy to ensure watertightness between different-sized electrical wires 13 and crimping terminals 11.

Furthermore, in the case of the electrical wire 13 having a conductor cross-sectional area of 0.75 $mm^2$, in which the outer diameter of the insulation covering portion 15 (the electrical wire diameter RB) is in the range of 1.3 to 1.9 mm, setting the inner diameter (the tube inner diameter B) of the second cylindrical portion 54 (the covering insertion portion) to be in the range of 1.0 to 1.4 times the electrical wire diameter RB makes it easy to ensure watertightness between the crimping terminal 11 and the electrical wire 13.

Additionally, in the case of the electrical wire 13 having a conductor cross-sectional area of 0.50 $mm^2$, in which the electrical wire diameter RB is in the range of 1.1 to 1.7 mm, setting the inner diameter (the tube inner diameter B) of the second cylindrical portion 54 (the covering insertion portion) to be in the range of 1.0 to 1.5 times the outer diameter of the insulation covering portion 15 makes it easy to ensure watertightness between the crimping terminal 11 and the electrical wire 13.

Furthermore, in the case of the electrical wire 13 having a conductor cross-sectional area of 0.35 $mm^2$, in which the electrical wire diameter RB is the range of 0.9 to 1.5 mm, setting the inner diameter (the tube inner diameter B) of the second cylindrical portion 54 (the covering insertion portion) to be in the range of 1.0 to 1.7 times the outer diameter of the insulation covering portion 15 makes it easy to ensure watertightness between the crimping terminal 11 and the electrical wire 13.

Additionally, setting the inner diameter (the tube inner diameter A) of the first cylindrical portion 52 (the conductor insertion portion) to be in the range of 1.1 to 2.0 times the outer diameter (the conductor outer diameter RA) of the core wire portion 14 (the conductor portion) makes it easy to both ensure watertightness and prevent abnormal deformation such as terminal inner falling after the crimping. Furthermore, these conditions can also be applied with ease to other crimping terminals 11 that crimp electrical wires 13 whose conductor cross-sectional areas are not in the range of 0.35 to 0.75 $mm^2$, and doing so makes it easy to ensure watertightness between different-sized electrical wires 13 and crimping terminals 11 as well as prevent abnormal deformation.

Furthermore, in the case of the electrical wire 13 having a conductor cross-sectional area of 0.75 $mm^2$, in which the electrical wire diameter RB is in the range of 0.9 to 1.3 mm, it is preferable that the tube inner diameter A be in the range of 1.1 to 1.8 times the conductor outer diameter RA. Limiting the tube inner diameter A to smaller than or equal to 1.4 times the conductor outer diameter RA further improves the watertightness and suppresses abnormal deformation. In the case of the electrical wire 13 having a conductor cross-sectional area of 0.50 $mm^2$, in which the electrical wire diameter RB is in the range of 0.8 to 1.1 mm, it is preferable that the tube inner diameter A be in the range of 1.1 to 1.7 times the conductor outer diameter RA. Limiting the tube inner diameter A to smaller than or equal to 1.5 times the conductor outer diameter RA further improves the watertightness and suppresses abnormal deformation. In the case of the electrical wire 13 having a conductor cross-sectional area of 0.35 $mm^2$, in which the electrical wire diameter RB is in the range of 0.6 to 0.9 mm, it is preferable that the tube inner diameter A be in the range of 1.1 to 2.0 times the conductor outer diameter RA. Limiting the tube inner diameter A to smaller than or equal to 1.6 times the conductor outer diameter RA further improves the watertightness and suppresses abnormal deformation.

Additionally, because the second cylindrical portion 54 (the covering insertion portion) and the first cylindrical portion 52 (the conductor insertion portion) are formed coaxially, the core wire portion 14 and the insulation covering portion 15 of the electrical wire 13 can be inserted smoothly into the first cylindrical portion 52 and the second cylindrical portion 54, respectively.

Furthermore, because the tubular portion 25 is formed as a closed cylindrical body in which portions aside from the electrical wire insertion opening 31 are closed off, watertightness can be ensured by taking care to close off the gap between the second cylindrical portion 54 (the covering insertion portion) and the insulation covering portion 15 (the covering portion) of the electrical wire 13. In other words, forming the tubular portion 25 as a closed cylindrical body and ensuring that the above-described conditions are met makes it possible to ensure watertightness efficiently.

Although the foregoing describes a case of applying the present invention to the electrical wire-connecting structure 10 such as that illustrated in FIG. 1, the present invention is not limited thereto. For example, although the foregoing describes an example in which the box portion 20 of the crimping terminal 11 has a female terminal, the configuration may be such that the box portion 20 has a male terminal (a male box). Additionally, the metal material that forms the core wire portion 14 may be a copper-based material, and a wide range of conductive metal materials usable as electrical wires can be employed.

REFERENCE SIGNS LIST

10 Electrical wire-connecting structure
11 Crimping terminal
13 Electrical wire (insulated electrical wire)
14 Core wire portion (conductor portion)
15 Insulation covering portion (covering portion)
15*a* Cover tip portion
20 Box portion
25 Tubular portion (stepped tube)
31 Electrical wire insertion opening (open portion)
52 First cylindrical portion (conductor insertion portion)
53 Flaring cylindrical portion (conductor guide)
54 Second cylindrical portion (covering insertion portion)

The invention claimed is:

1. A method for manufacturing an electrical wire-connecting structure including a terminal having a tubular portion and an insulated electrical wire having a conductor portion, the terminal and the conductor portion being crimped at the tubular portion, the method comprising:

preparing the terminal by punching out a plate-like material and bending the plate-like material into an approximately cylindrical shape, and joining and welding edges of the plate-like material at a joining part to form the tubular portion, the terminal having the tubular portion in which a conductor insertion portion into which the conductor portion is inserted is formed with a smaller diameter than a covering insertion portion into which a covering portion of the insulated electrical wire is inserted, and an inner diameter of the covering insertion portion is in a range of 1.0 to 1.7 times an outer diameter of the covering portion;

collapsing and welding closed an end portion of the tubular portion remote from an electrical wire insertion opening so as to form a closed cylindrical body in which portions aside from the electrical wire insertion opening are closed off from the end portion toward the electrical wire insertion opening:

inserting the insulated electrical wire into the tubular portion; and compressively crimping the covering insertion portion and the covering portion.

2. The method for manufacturing an electrical wire-connecting structure according to claim 1, wherein in a case where the outer diameter of the covering portion of the insulated electrical wire is in a range of 1.3 to 1.9 mm, the inner diameter of the covering insertion portion is set to be in a range of 1.0 to 1.4 times the outer diameter of the covering portion.

3. The method for manufacturing an electrical wire-connecting structure according to claim 1, wherein in a case where the outer diameter of the covering portion of the insulated electrical wire is in a range of 1.1 to 1.7 mm, the inner diameter of the covering insertion portion is set to be in a range of 1.0 to 1.5 times the outer diameter of the covering portion.

4. The method for manufacturing an electrical wire-connecting structure according to claim 1, wherein in a case where the outer diameter of the covering portion of the insulated electrical wire is in a range of 0.9 to 1.5 mm, the inner diameter of the covering insertion portion is set to be in a range of 1.0 to 1.7 times the outer diameter of the covering portion.

5. The method for manufacturing an electrical wire-connecting structure according to claim 1, wherein the inner diameter of the conductor insertion portion is set to be in a range of 1.1 to 2.0 times the outer diameter of the conductor portion.

6. The method for manufacturing an electrical wire-connecting structure according to claim 1, wherein the covering insertion portion and the conductor insertion portion are formed coaxially.

7. The method for manufacturing an electrical wire-connecting structure according to claim 2, wherein a length of the covering insertion portion is tffeater than or equal to 0.8 times the outer diameter of the covering portion.

8. The method for manufacturing an electrical wire-connecting structure according to claim 3, wherein a length of the covering insertion portion is greater than or equal to 0.8 times the outer diameter of the covering portion.

9. The method for manufacturing an electrical wire-connecting structure according to claim 4, wherein a length of the covering insertion portion is areater than or equal to 0.7 times the outer diameter of the covering portion.

10. An electrical wire-connecting structure comprising:

a terminal having a tubular portion; and an insulated electrical wire having a conductor portion, the terminal and the conductor portion being crimped at the tubular portion, wherein the tubular portion is formed of a plate-like material rolled up into a substantially cylindrical shape with edges of the plate-like material being welded together at a joining part so that a conductor insertion portion into which the conductor portion is inserted is formed with a smaller diameter than a covering insertion portion into which a covering portion of the insulated electrical wire is inserted and so that an inner diameter of the covering insertion portion is in a range of 1.0 to 1.7 times an outer diameter of the covering portion, and the covering insertion portion and the covering portion are compressively crimped, and an end portion of the tubular portion remote from an electrical wire insertion opening is collapsed and welded closed so as to form a closed cylindrical body in which portions aside from the electrical wire insertion opening are closed off from the end portion toward the electrical wire insertion opening.

11. The method for manufacturing an electrical wire-connecting structure according to claim 1, wherein the compressively crimping includes crimping the conductor insertion portion of the tubular portion toward the conductor portion of the electrical wire so as to form a crimp impression that is recessed toward the conductor portion of the electrical wire.

12. The method for manufacturing an electrical wire-connecting structure according to claim 11, wherein the compressively crimping includes forming the crimp impression at a position where the edges of the plate-like material are joined and welded to form the tubular portion.

13. The method for manufacturing an electrical wire-connecting structure according to claim 1, wherein the compressively crimping includes crimping the covering portion of the tubular portion to a substantially perfect circle.

* * * * *